US010978034B2

(12) United States Patent
Sasaki

(10) Patent No.: US 10,978,034 B2
(45) Date of Patent: Apr. 13, 2021

(54) ELECTRONIC WIND INSTRUMENT, MUSICAL SOUND GENERATION DEVICE, MUSICAL SOUND GENERATION METHOD AND STORAGE MEDIUM STORING PROGRAM

(71) Applicant: CASIO COMPUTER CO., LTD., Tokyo (JP)

(72) Inventor: Hiroyuki Sasaki, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/872,453

(22) Filed: May 12, 2020

(65) Prior Publication Data

US 2020/0372888 A1 Nov. 26, 2020

(30) Foreign Application Priority Data

May 24, 2019 (JP) ..... JP2019-097466

(51) Int. Cl.
*G10H 3/14* (2006.01)
*G10H 5/02* (2006.01)
*G10H 1/34* (2006.01)

(52) U.S. Cl.
CPC ..... *G10H 3/143* (2013.01); *G10H 1/348* (2013.01); *G10H 5/02* (2013.01)

(58) Field of Classification Search
CPC ..... G10H 3/143; G10H 1/348; G10H 5/02
USPC ..... 84/93
See application file for complete search history.

(56) References Cited

U.S. PATENT DOCUMENTS 3,557,295 A * 1/1971 Takeshi ..... G10H 1/14 84/699
5,140,888 A * 8/1992 Ito ..... G10H 1/055 84/723
6,372,973 B1 * 4/2002 Schneider ..... G10H 1/20 84/609
6,653,546 B2 * 11/2003 Jameson ..... G10H 3/125 84/616

(Continued)

FOREIGN PATENT DOCUMENTS

JP S49009369 B1 3/1974
JP H02003588 U 1/1990

(Continued)

*Primary Examiner* — David S Warren
*Assistant Examiner* — Christina M Schreiber
(74) *Attorney, Agent, or Firm* — Holtz, Holtz & Volek PC

(57) ABSTRACT

A musical sound generation device including a blowing pressure sensor which detects a blowing pressure, a key switch which specifies a sound pitch of a musical sound, a first sound source which outputs a first signal corresponding to an exhalation sound, a second sound source which outputs a second signal corresponding to the musical sound having the sound pitch specified by the key switch, and a processor which starts output of the first signal by the first sound source on basis of an operation performed on the key switch, starts output of the second signal by the second sound source on basis of the blowing pressure, and controls a sound volume when the exhalation sound resulting from the first signal is emitted and a sound volume when the musical sound resulting from the second signal is emitted, on basis of the blowing pressure.

11 Claims, 10 Drawing Sheets

(56) References Cited

U.S. PATENT DOCUMENTS 6,881,890 B2 * 4/2005 Sakurada ..... G10H 5/005 84/654
6,995,307 B2 * 2/2006 Britton ..... G10H 1/26 84/387 R
7,049,503 B2 * 5/2006 Onozawa ..... G10H 1/055 84/723
7,309,827 B2 * 12/2007 Sakurada ..... G10H 5/005 704/207
7,321,094 B2 * 1/2008 Sakurada ..... G10H 1/0016 84/477 R
7,741,555 B2 * 6/2010 Onozawa ..... G10H 1/34 84/653
7,829,780 B2 * 11/2010 Onozawa ..... G10D 7/00 84/732
7,858,871 B2 * 12/2010 Fujii ..... G10D 9/03 84/723
8,309,837 B2 * 11/2012 Hashimoto ..... G10H 1/053 84/737
9,564,114 B2 * 2/2017 Nakae ..... G10H 3/182
9,640,152 B2 * 5/2017 Allendorph ..... G10H 1/0091
10,347,222 B2 * 7/2019 Sasaki ..... G10B 3/22
10,360,884 B2 * 7/2019 Okuda ..... G10H 1/0551
10,490,174 B2 * 11/2019 Harada ..... G10H 1/0008
2004/0144239 A1 * 7/2004 Sakurada ..... G10H 5/005 84/616
2007/0017352 A1 * 1/2007 Masuda ..... G10H 5/007 84/658
2007/0137468 A1 * 6/2007 Shibata ..... G10H 1/20 84/723
2012/0073424 A1 * 3/2012 Hashimoto ..... G10H 1/0008 84/622
2018/0082664 A1 * 3/2018 Sasaki ..... H03H 7/01
2020/0372888 A1 * 11/2020 Sasaki ..... G10H 5/02

FOREIGN PATENT DOCUMENTS

JP H0511758 A 1/1993
JP 2004212578 A 7/2004

* cited by examiner

ELECTRONIC WIND INSTRUMENT, MUSICAL SOUND GENERATION DEVICE, MUSICAL SOUND GENERATION METHOD AND STORAGE MEDIUM STORING PROGRAM

CROSS-REFERENCE TO RELATED APPLICATION

This application is based upon and claims the benefit of priority from the prior Japanese Patent Application No. 2019-097466, filed May 24, 2019, the entire contents of which are incorporated herein by reference.

BACKGROUND OF THE INVENTION

1. Field of the Invention

The present invention relates to a musical sound generation technique for electronic wind instruments.

2. Description of the Related Art

Conventionally, electronic musical instruments whose shapes, musical performance methods, and sound emission characteristics are modeled after those of acoustic musical instruments are known. For example, as for acoustic wind instruments such as saxophones, an instrument player blows breath into a mouthpiece and thereby vibrates a reed so as to generate sounds. Here, before a musical sound of a specified pitch is emitted by the instrument player operating a key switch, an exhalation sound caused by breath (exhalation) blown into the mouthpiece always occurs. Accordingly, a method has been proposed by which a sound emission characteristic and a musical performance effect related to exhalation sound which are close to those of actual acoustic wind instruments are actualized in an electronic musical instrument.

For example, Japanese Patent Application Laid-Open (Kokai) Publication No. 2004-212578 discloses a technique related to a musical sound generation device for an electronic musical instrument, in which a noise sound equivalent to an exhalation sound is emitted from when an instrument player starts blowing breath until when a musical sound of a specified pitch is emitted. In this technique, the pitch and amplitude level of a vibration signal accompanying the blowing of breath are detected and, when the amplitude level exceeds a predetermined value, a noise sound is emitted. Then, when the pitch detection is concluded, the noise sound is switched to a musical sound of a sound pitch determined based on the detected pitch and a fingering status, so that the musical sound is emitted.

SUMMARY OF THE INVENTION

In accordance with one aspect of the present invention, there is provided a musical sound generation device comprising: a blowing pressure sensor which detects a blowing pressure; a key switch which specifies a sound pitch of a musical sound; a first sound source which outputs a first signal corresponding to an exhalation sound; a second sound source which outputs a second signal corresponding to the musical sound having the sound pitch specified by the key switch; and a processor, wherein the processor (i) starts output of the first signal by the first sound source on basis of an operation performed on the key switch, (ii) starts output of the second signal by the second sound source on basis of the blowing pressure detected by the blowing pressure sensor, and (iii) controls a sound volume when the exhalation sound resulting from the first signal is emitted and a sound volume when the musical sound resulting from the second signal is emitted, on basis of the blowing pressure.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

An embodiment of an electronic wind instrument, a musical sound generation device, a musical sound generation method and a program storage medium according to the present invention will hereinafter be described with reference to the drawings.

Figure 1:
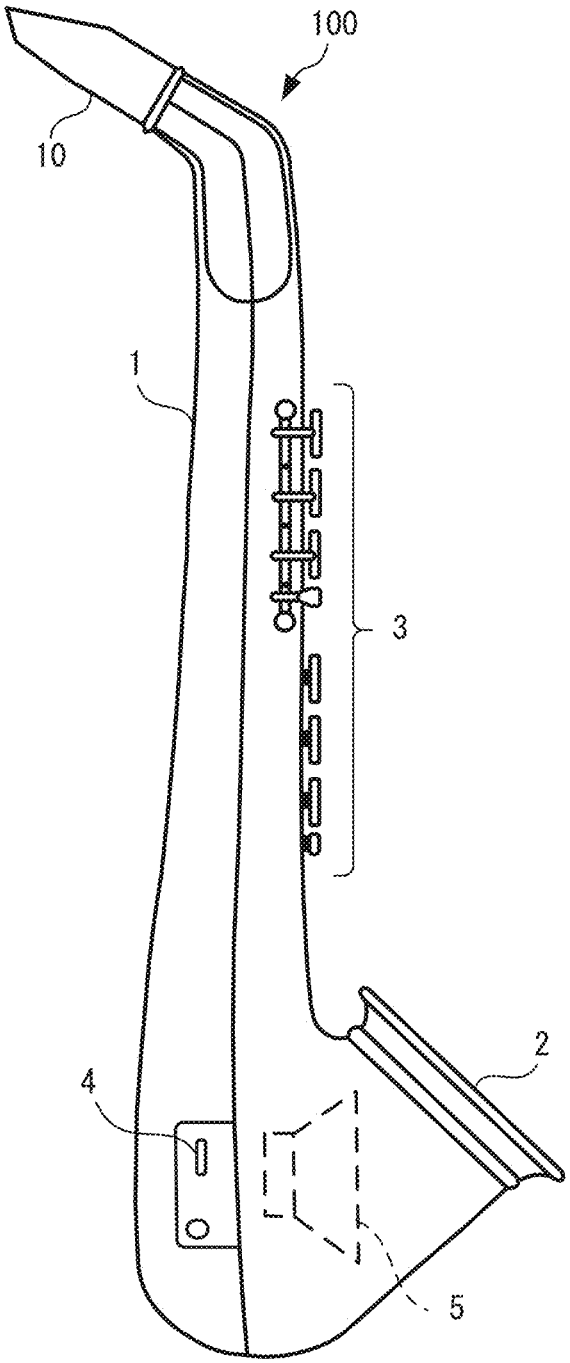
FIG. 1 is an external view showing the entire structure of an electronic wind instrument according to an embodiment of the present invention.

FIG. 1 is an external view showing the entire structure of an electronic wind instrument 100 according to an embodiment of the present invention.

The electronic wind instrument 100 where the present invention has been applied has, for example, an outer shape modeled after that of a saxophone which is an acoustic wind instrument, as shown in FIG. 1. To one end side (the upper end side in the drawing) of a tubular instrument main body 1 of this electronic wind instrument 100, a mouthpiece 10 is attached. In addition, on the other end side (the lower end side in the drawing), a sound emission section 2 is provided from which musical sounds are emitted. The mouthpiece 10 includes at least a blowing pressure sensor for detecting the pressure (blowing pressure) of an instrument player's breath blown from the blowing-in tip opening of the mouthpiece 10. Also, in an inner area on the sound emission section 2 side of the instrument main body 1, a speaker 5 is provided. On a side surface (for example, the right side surface in the drawing) of the instrument main body 1, a plurality of finger hole switches 3 for specifying sound pitches by fingering operations is arranged. On a different side surface (for example, the near side surface in the drawing) of the instrument main body 1, an operation section 4 is provided which has various types of operation switches for controlling the musical performance status of the electronic wind instrument 100 and a power supply switch. Although not shown in the drawing, a control section is provided in the instrument main body 1, which controls the pitch, volume, and tone of each musical sound to be emitted from the speaker 5 on the basis of a detection signal outputted from the blowing pressure sensor provided in the mouthpiece 10, a sound pitch specified by a finger hole switch 3, and a control signal outputted from the operation section 4.

Figure 2:
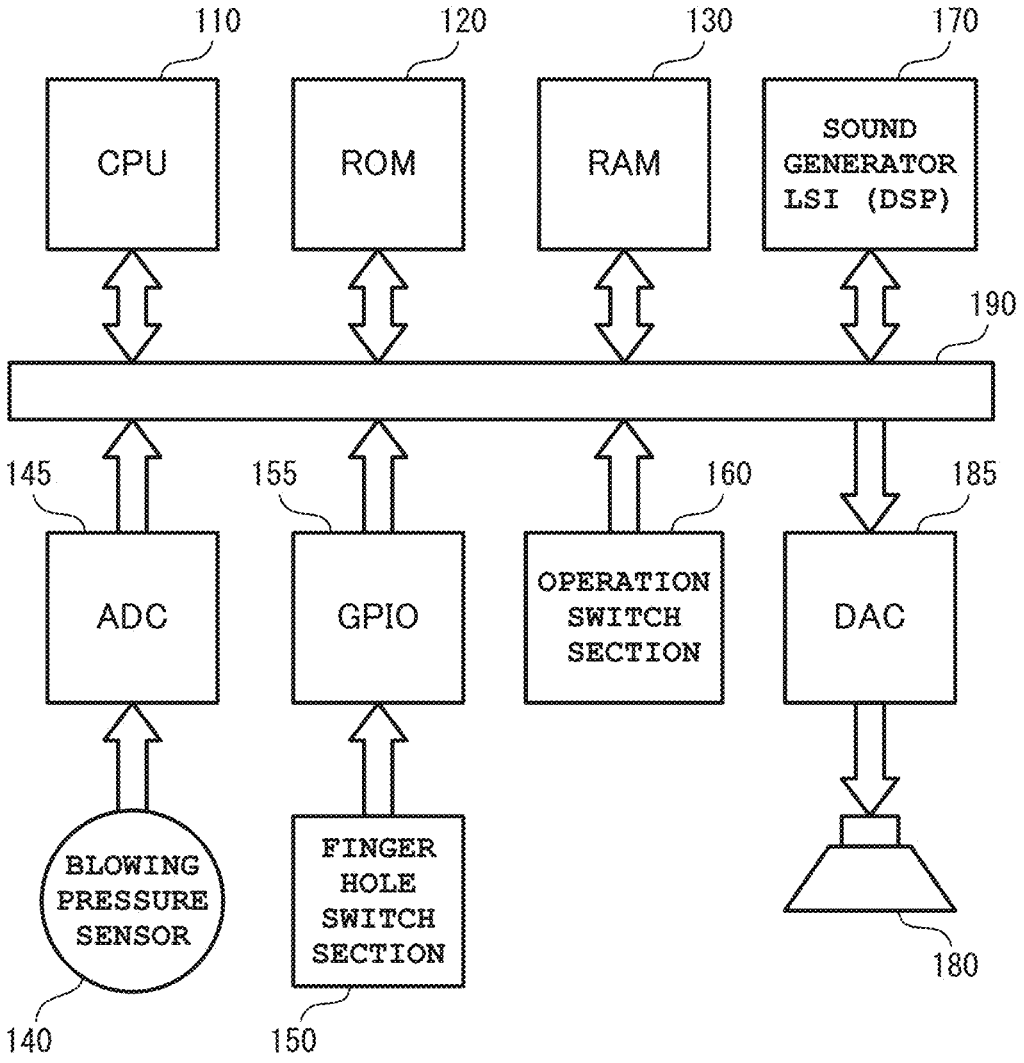
FIG. 2 is a block diagram showing an example of the hardware structure of the electronic wind instrument according to the embodiment of the present invention.

FIG. 2 is a block diagram showing an example of the hardware structure of the electronic wind instrument 100 according to the present embodiment. As shown in this FIG. 2, the electronic wind instrument 100 according to the present embodiment includes, for example, a CPU (Central Processing Unit) 110, a ROM (Read-Only Memory) 120, a RAM (Random Access Memory) 130, the blowing pressure sensor 140, a finger hole switch section 150, an operation switch section 160, a sound generator LSI 170, and a sound emission section 180, which are directly or indirectly connected to a bus 190 and thereby connected to one another via the bus 190. Here, the blowing pressure sensor 140 is connected to the bus 190 via an ADC (Analog-to-Digital Converter) 145, the finger hole switch section 150 is connected to the bus 190 via a GPIO (General-Purpose Input/Output) 155, and the sound emission section 180 is connected to the bus 190 via a DAC (Digital-to-Analog Converter) 185. Note that the structure of the present embodiment is merely an example for actualizing an electronic wind instrument according to the present invention, and the present invention is not limited thereto.

The CPU 110 corresponds to the above-described control section, and performs the following control by executing a predetermined program stored in the ROM 120. That is, the CPU 110 controls the sound source to replay musical sounds of pitches specified by fingering operations performed on the finger hole switch section 150. In addition, the CPU 110 controls the pitch, volume, and tone of each musical sound to be replayed on the basis of a blowing pressure detected by the blowing pressure sensor 140 and a control signal outputted from the operation switch section 160 during a musical performance. Moreover, in the present embodiment, the CPU 110 controls such that an exhalation sound having a predetermined sound pitch and a predetermined sound volume is emitted in a time period during which a musical sound of a pitch specified by the finger hole switch section 150 is emitted and time periods around this sound emission on the basis of a blowing pressure detected by the blowing pressure sensor 140. Note that details of a musical sound generation method to be performed by this CPU 110 and the later-described sound generator LSI 170 are described later.

The ROM 120 has stored therein control programs that are executed by the CPU 110 to control various operations of the electronic wind instrument 100 during a musical performance. In particular, in the present embodiment, the ROM 120 has stored therein a musical sound generation program in which an algorithm for actualizing the later-described musical sound generation method has been incorporated.

Also, in the ROM 120, as sound source data to be used in the generation of musical sounds and exhalation sounds in the sound generator LSI 170 described later, the waveform data of pitch sound components for generating musical sounds and the waveform data of noise sound components for generating exhalation sounds are stored in the forms of individualized waveform tables. The sound source data herein are acquired by the waveform data of pitch sound components corresponding to musical sounds and the waveform data of noise sound components corresponding to exhalation sounds being separated and extracted from the waveforms of sounds recorded in PCM (Pulse Code Modulation) in an actual musical performance using an acoustic wind instrument and other musical instruments. Here, waveform data corresponding to the fundamental frequency of a pitch sound of a specific pitch and the harmonic components thereof is separated and extracted as pitch sound component waveform data, and waveform data acquired by the pitch sound component waveform data being subtracted from a PCM recorded sound waveform that is the original sound is separated and extracted as noise sound component waveform data. Such waveform data extraction processing is achieved by using, for example, a comb filter that is well-known frequency analysis means.

The RAM 130 sequentially acquires and temporarily stores data that are generated when the CPU 110 executes the control program during a musical performance using the electronic wind instrument 100 and blowing pressures detected by the blowing pressure sensor 140. Note that the above-described sound source data may be stored in the RAM 130 instead of the ROM 120.

The blowing pressure sensor 140 detects a blowing pressure when the instrument player is performing a musical performance while holding the mouthpiece 10 in the mouth, on the basis of the amount of breath blown from the blowing-in tip opening of the mouthpiece 10. This blowing pressure detected as an analog voltage value by the blowing pressure sensor 140 is converted to a digital voltage value by the ADC 145, and acquired by the CPU 110.

In this embodiment, as a sensor provided in the mouthpiece 10 or an area around the mouthpiece 10, only the blowing pressure sensor 140 has been described. However, various types of sensors for detecting a blowing state during a musical performance may be provided. More specifically, a voice sensor for detecting voice from the instrument player, a bite sensor for detecting the pressure of biting the reed of the mouthpiece 10, a lip sensor for detecting the contact position of the lip, a tongue sensor for detecting the contact state of the tongue with respect to the reed, and the like may be provided.

The finger hole switch section 150 corresponds to the finger hole switches 3 shown in FIG. 1, and outputs an ON/OFF signal in accordance with a sound pitch specified by a fingering operation by the instrument player. This ON/OFF signal is loaded into the CPU 110 via the GPIO 155. The operation switch section 160 corresponds to the operation section 4 shown in FIG. 1, and outputs control signals for setting the tone and sound volume of a musical sound that is emitted from the sound emission section 2. These control signals are loaded into the CPU 110.

The sound generator LSI 170, which includes a DSP (Digital Signal Processor), extracts predetermined waveform data from sound source data stored in the ROM 120 in response to an instruction from the CPU 110, and generates a digital sound signal where a musical sound constituted by a pitch sound component has been mixed with an exhalation sound constituted by a noise sound component. As described above, in the present embodiment, a pitch sound source where pitch sound component waveform data corresponding to musical sounds have been stored and a noise sound source where noise sound component waveform data corresponding to exhalation sounds have been stored are provided as sound sources to be used in the sound generator LSI 170. The sound generator LSI 170 combines the waveform data of a musical sound and that of an exhalation sound generated at predetermined timings by the above-described sound sources on the basis of a sound pitch specified by the finger hole switch section 150 and a blowing pressure acquired by the blowing pressure sensor 140, and transmits the resultant data to the sound emission section 180 as a digital sound signal. Here, the generation timing of the exhalation sound is set such that the exhalation sound is emitted in a time period during which the musical sound is emitted and time periods around this sound emission.

The sound emission section 180 includes the speaker 5 shown in FIG. 1. Digital sound signals generated by the sound generator LSI 170 are converted to analog signals by the DAC, and emitted as musical instrument sounds from this speaker 5 at a predetermined sound volume.

(Control Method for Electronic Wind Instrument)

Next, a control method for the electronic wind instrument according to the present embodiment is described. Note that the below-described control method for the electronic wind instrument includes the musical sound generation method that is actualized by the musical sound generation program having the specific algorithm incorporated therein being executed in the CPU 110 and sound generator LSI 170 of the electronic wind instrument 100 described above.

Figure 3:
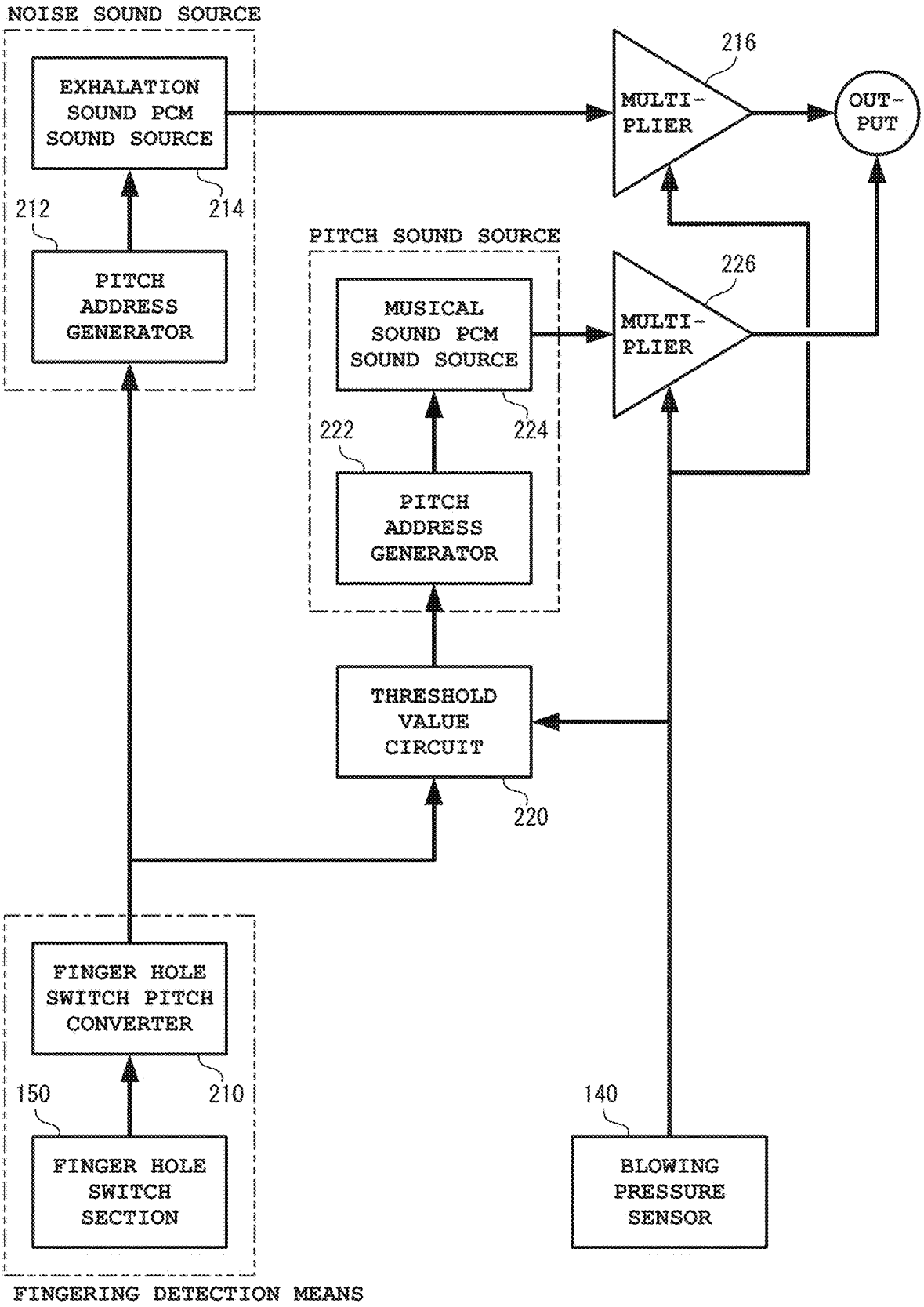
FIG. 3 is a functional block diagram for describing a musical sound generation method applied in the electronic wind instrument according to the embodiment of the present invention.
Figure 4:
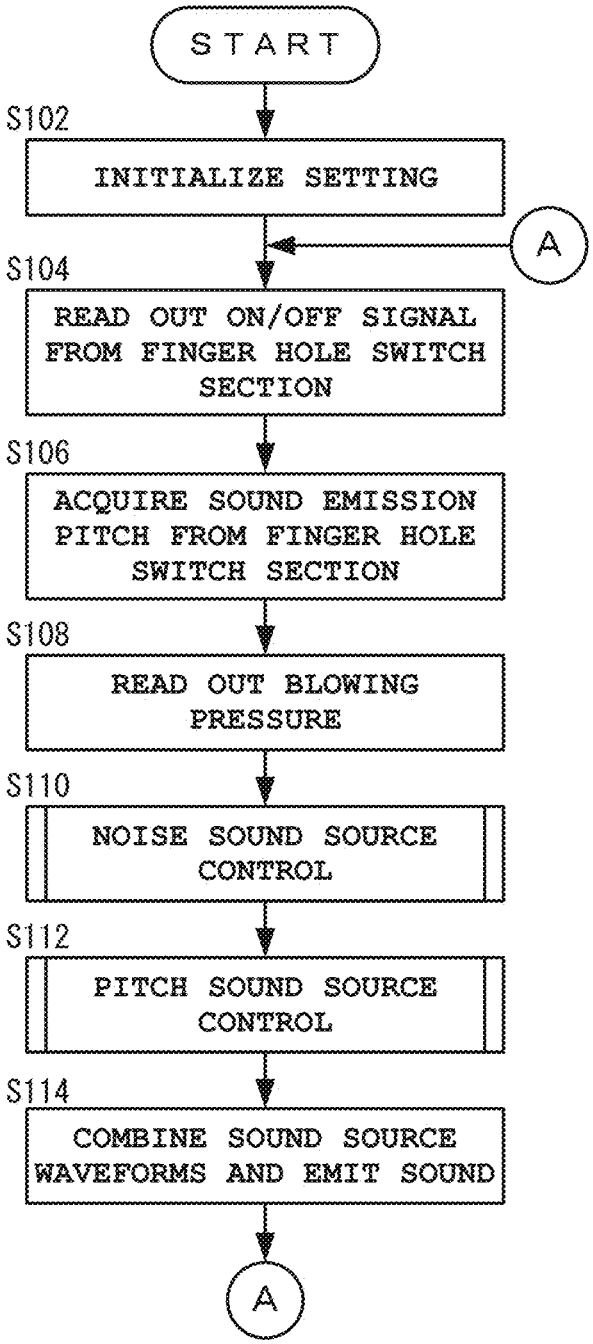
FIG. 4 is a flowchart (main flow) showing an example of a control method for the electronic wind instrument according to the embodiment of the present invention.
Figure 5:
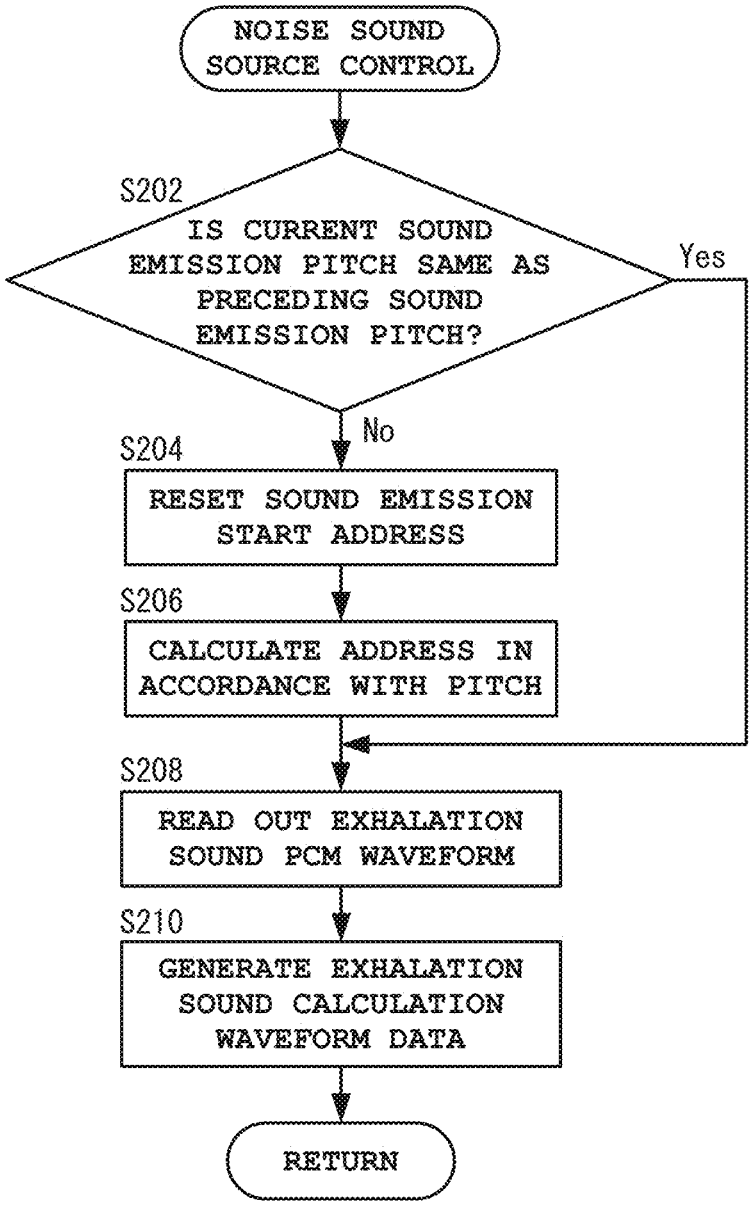
FIG. 5 is a flowchart showing an example of a noise sound source control method applied in the embodiment of the present invention.
Figure 6:
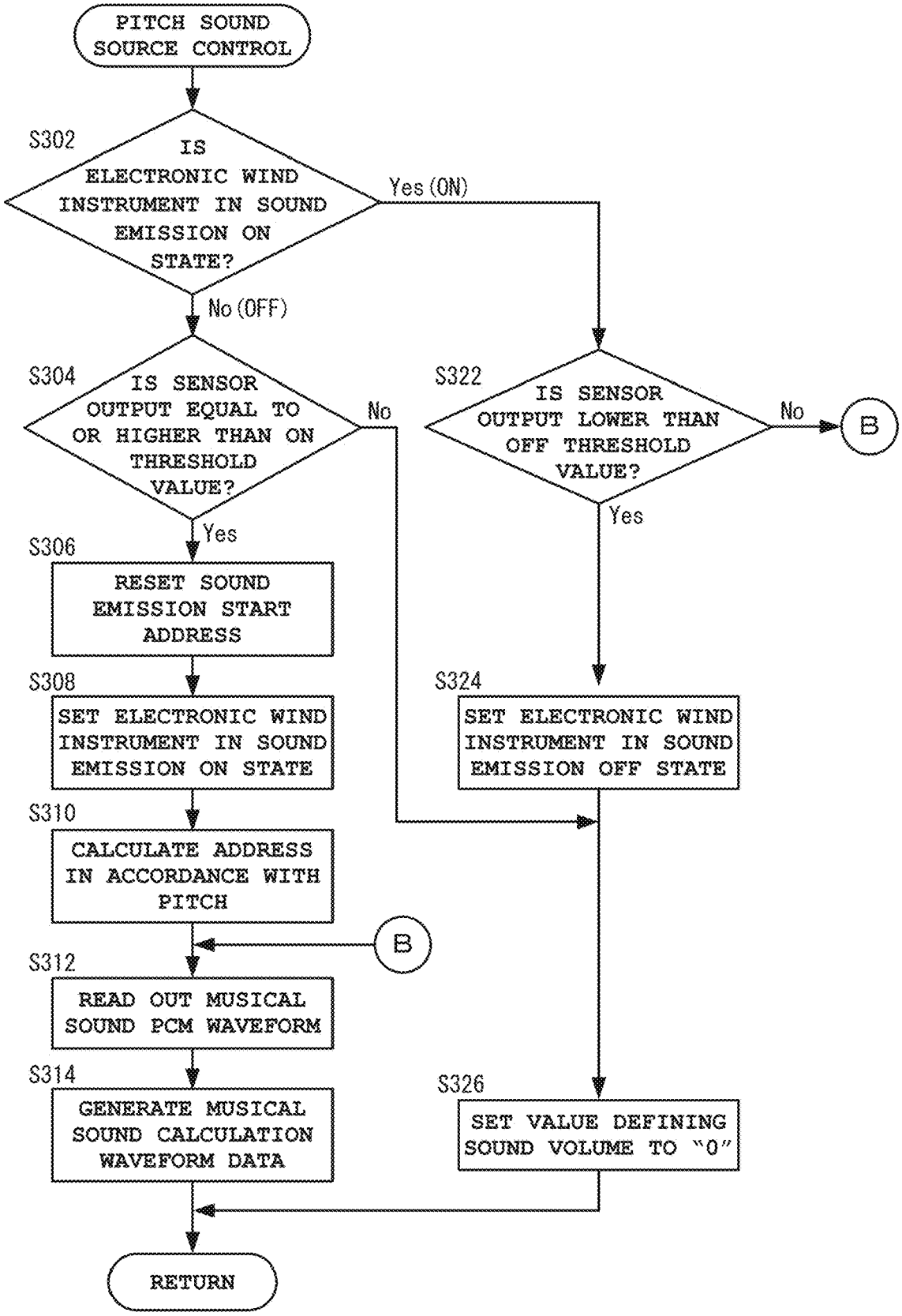
FIG. 6 is a flowchart showing an example of a pitch sound source control method applied in the embodiment of the present invention.

FIG. 3 is a functional block diagram for describing the musical sound generation method applied in the electronic wind instrument according to the present embodiment, and FIG. 4 is a flowchart (main flow) showing an example of the control method for the electronic wind instrument according to the present embodiment. Also, FIG. 5 is a flowchart showing an example of a noise sound source control method applied in the present embodiment of the present invention, and FIG. 6 is a flowchart showing an example of a pitch sound source control method applied in the present embodiment.

In the electronic wind instrument 100 according to the present embodiment, the later-described musical sound generation processing is executed by a musical sound generation device having the functional blocks shown in FIG. 3. This musical sound generation device according to the present embodiment is provided with a pitch sound source having a musical sound PCM sound source 224 in which the waveform data of pitch sound components corresponding to the respective sound pitches have been stored and a noise sound source having an exhalation sound PCM sound source 214 in which the waveform data of noise sound components corresponding to the respective sound pitches have been stored.

The musical sound generation device is also provided with fingering detection means which acquires a sound emission pitch that is pitch information regarding a musical sound to be emitted on the basis of an ON/OFF signal outputted from the finger hole switch section 150, by a finger hole switch pitch converter 210 configured by software. The finger hole switch pitch converter 210 herein determines a sound emission pitch with reference to a reference table (wave table) uniquely defining which sound is to be outputted with respect to an ON/OFF signal outputted from the finger hole switch section 150. This sound emission pitch is directly transmitted to the noise sound source, and also transmitted to the pitch sound source via a threshold value circuit 220 configured by software, as a pitch signal.

In the noise sound source, at the timing of the transmission of a pitch signal from the fingering detection means, a noise sound (the signal of the waveform data of a noise sound component; first signal) corresponding to an exhalation sound is promptly generated on the basis of the pitch signal. In the pitch sound source, at the timing of the transmission of a pitch signal from the threshold value circuit 220, a pitch sound (the signal of the waveform data of a pitch sound component; second signal) corresponding to a musical sound is generated. The threshold value circuit 220 herein temporarily stores a pitch signal transmitted from the fingering detection means. In addition, this threshold value circuit 220 compares a blowing pressure detected by the blowing pressure sensor 140 with a preset threshold value (ON threshold value or OFF threshold value), and determines whether to output the corresponding pitch signal to the pitch sound source on the basis of the comparison result.

In the present embodiment (FIG. 3), the configuration has been adopted in which a pitch signal transmitted from the fingering detection means has a role in specifying a sound pitch and a role in specifying the output timing of a noise sound and that of a pitch sound in the noise sound source and the pitch sound source. However, the present invention is not limited thereto. That is, a configuration may be adopted in which a signal specifying a sound pitch and a signal specifying the output timing of a noise sound and that of a pitch sound are individually inputted to each sound source of the noise sound source and the pitch sound source.

By multipliers 216 and 226, a noise sound generated in the noise sound source and a pitch sound generated in the pitch sound source are each set to have a sound volume in accordance with a blowing pressure detected by the blowing pressure sensor 140. These noise and pitch sounds whose sound volumes have been set are combined and emitted from the sound emission section 180 as a musical instrument sound. For example, the multipliers 216 and 226 herein are set such that the sound volumes of a noise sound and a pitch sound are linearly increased as a blowing pressure detected by the blowing pressure sensor 140 becomes higher. Note that the change characteristic in setting the sound volume of a noise sound in relation to a blowing pressure and the change characteristic in setting the sound volume of a pitch sound in relation to the blowing pressure may have the same linearity or may have different linearities. Also, when the blowing pressure is "0" (that is, no breath has been blown into the mouthpiece 10), the multipliers 216 and 226 set noise and pitch sound volumes at "0" so as to actually stop sound emission.

Hereafter, the control method (musical sound generation method) for the electronic wind instrument according to the present embodiment is concretely described with reference to the functional blocks in FIG. 3 and the flowcharts in FIG.

4 to FIG. 6. In the control method for the electronic wind instrument, before the instrument player starts a musical performance using the electronic wind instrument 100, the CPU 110 deletes temporarily stored data in the RAM 130 for initialization (Step S102), as shown in the flowchart in FIG. 4. Then, when the instrument player operates the finger hole switch section 150 to specify an intended sound pitch, the CPU 110 reads out an ON/OFF signal from the finger hole switch section 150 via the GPIO 155 (Step S104). Subsequently, by the finger hole switch pitch converter 210, the CPU 110 acquires a sound emission pitch (pitch information) of a musical sound to be emitted on the basis of the ON/OFF signal read out from the finger hole switch section 150 (Step S106). This acquired sound emission pitch is directly transmitted to the noise sound source as a pitch signal, and also transmitted to the threshold value circuit 220 for temporary storage.

Here, when the instrument player blows breath from the blowing-in tip opening of the mouthpiece 10 in time with the operation of the finger hole switch section 150, the CPU 110 reads out a voltage value corresponding to a blowing pressure detected by the blowing pressure sensor 140 via the ADC 145 (Step S108).

Next, the CPU 110 controls the noise sound source and the pitch sound source by the sound generator LSI 170 and thereby concurrently performs noise sound source control processing (Step S110) and pitch sound source control processing (Step S112) described below.

In the noise sound source control processing, the CPU 110 first judges whether the current sound emission pitch acquired at Step S106 is the same as the preceding sound emission pitch (Step S202), as shown in the flowchart in FIG. 5. When the current sound emission pitch is not the same as the preceding sound emission pitch (NO at Step S202), the sound generator LSI 170 resets the preceding sound emission start address which has been temporarily stored, in response to an instruction from the CPU 110 (Step S204). Then, by using a pitch address generator 212 configured by software, the sound generator LSI 170 calculates a sound emission start address in accordance with the current sound emission pitch outputted as a pitch signal from the finger hole switch pitch converter 210 (Step S206). The sound emission start address herein is a storage area address that is used when the waveform data of a noise sound component in accordance with a sound emission pitch outputted as a pitch signal from the finger hole switch pitch converter 210 is extracted in the exhalation sound PCM sound source 214 where the waveform data of noise sound components corresponding to the respective sound pitches have been stored.

Next, on the basis of the calculated sound emission start address, the sound generator LSI 170 reads out the waveform data of a noise sound component corresponding to an exhalation sound to be replayed, from the exhalation sound PCM sound source 214 (Step S208). At Step S202, when the current sound emission pitch is the same as the preceding sound emission pitch (YES at Step S202), the sound generator LSI 170 reads out the waveform data of a noise sound component corresponding to an exhalation sound to be replayed from the exhalation sound PCM sound source 214, on the basis of a sound emission start address in accordance with the preceding sound emission pitch that has been temporarily stored (Step S208).

Next, by the multiplier 216, the sound generator LSI 170 multiplies the waveform data of the noise sound component read out from the exhalation sound PCM sound source 214 by a value (sound volume setting value) in accordance with the blowing pressure detected by the blowing pressure sensor 140 at Step S108, and thereby generates exhalation sound calculation waveform data (Step S210). Then, the sound generator LSI 170 ends the noise sound source control processing, and returns to the main flow shown in FIG. 4.

As a result of the above-described configuration, when a sound emission pitch based on a sound pitch specified by a fingering operation is determined and transmitted as a pitch signal, an exhalation sound having a noise sound component in accordance with the sound pitch is promptly generated and set to have a sound volume in accordance the amount of breath (blowing pressure) blown into the mouthpiece 10.

On the other hand, in the pitch sound source control processing, the CPU 110 first judges whether the electronic wind instrument 100 is in a state (sound emission ON state) of emitting a pitch sound corresponding to a musical sound of a musical performance (Step S302), as shown in the flowchart in FIG. 6. Then, when the electronic wind instrument 100 is in a sound emission OFF state (NO at Step S302), the sound generator LSI 170 receives an instruction from the CPU 110 and thereby compares the blowing pressure (shown as "sensor output" in FIG. 6) detected by the blowing pressure sensor 140 at Step S108 with a preset ON threshold value by the threshold value circuit 220 (Step S304). Here, when the blowing pressure detected by the blowing pressure sensor 140 is lower than the ON threshold value (NO at Step S304), the sound generator LSI 170 sets a value defining the sound volume of the musical sound to "0" without generating a pitch sound corresponding to the musical sound (Step S326), and then ends the pitch sound source control processing so as to return to the main flow shown in FIG. 4.

Conversely, when the blowing pressure detected by the blowing pressure sensor 140 is equal to or higher than the ON threshold value (YES at Step S304), the sound generator LSI 170 resets the preceding sound emission start address which has been temporarily stored (Step S306), and the CPU 110 sets the electronic wind instrument 100 to be in the sound emission ON state (Step S308). Then, by using a pitch address generator 222 configured by software, the sound generator LSI 170 calculates a sound emission start address in accordance with the current sound emission pitch outputted as a pitch signal from the finger hole switch pitch converter 210 (Step S310). Here, the current sound emission pitch acquired at Step S106 is transmitted to and temporarily stored in the threshold value circuit 220 as a pitch signal, and then outputted to the pitch address generator 222 in accordance with a result of the comparison processing (Step S304) in the threshold value circuit 220, as described above. Also, the sound emission start address herein is a storage area address that is used when the waveform data of a pitch sound component in accordance with a sound emission pitch outputted as a pitch signal from the finger hole switch pitch converter 210 is extracted in the musical sound PCM sound source 224 where the waveform data of pitch sound components corresponding to the respective sound pitches have been stored.

Next, the sound generator LSI 170 reads out the waveform data of a pitch sound component corresponding to the musical sound to be replayed from the musical sound PCM sound source 224, on the basis of the calculated sound emission start address (Step S312). Subsequently, by the multiplier 226, the sound generator LSI 170 multiplies the waveform data of the pitch sound component readout from the musical sound PCM sound source 224 by the value (sound volume setting value) in accordance with the blowing pressure detected by the blowing pressure sensor 140 at Step S108, and thereby generates musical sound calculation waveform data (Step S314). Then, the sound generator LSI 170 ends the pitch sound source control processing, and returns to the main flow shown in FIG. 4.

As a result of the above-described configuration, in the state where the electronic wind instrument 100 is not emitting any musical sound, the generation of a musical sound having a pitch sound component in accordance with a sound pitch specified by a fingering operation is started at timing at which the amount of breath (blowing pressure) blown into the mouthpiece 10 by the instrument player becomes equal to or greater than the predetermined threshold value (ON threshold value). In addition, the musical sound is set to have a sound volume in accordance the amount of the breath (blowing pressure) blown into the mouthpiece 10.

At Step S302, when the electronic wind instrument 100 is in the sound emission ON state (YES at Step S302), the sound generator LSI 170 receives an instruction from the CPU 110 and thereby compares the blowing pressure detected by the blowing pressure sensor 140 with a preset OFF threshold value by the threshold value circuit 220 (Step S322). Note that the OFF threshold value herein may be the same as the above-described ON threshold value or may be different from it. Then, when the blowing pressure detected by the blowing pressure sensor 140 is lower than the OFF threshold value (YES at Step S322), the CPU 110 sets the electronic wind instrument 100 to be in the sound emission OFF state (Step S324). Subsequently, the sound generator LSI 170 sets the value defining the sound volume of the musical sound to "0" without generating a pitch sound corresponding to the musical sound (Step S326), and then ends the pitch sound source control processing so as to return to the main flow shown in FIG. 4.

Conversely, when the blowing pressure detected by the blowing pressure sensor 140 is equal to or higher than the OFF threshold value (NO at Step S322), the sound generator LSI 170 reads out the waveform data of the pitch sound component from the musical sound PCM sound source 224 on the basis of the sound emission start address in accordance with the sound emission pitch that is being used in the current sound emission state (Step S312). Subsequently, the sound generator LSI 170 multiplies the waveform data of the pitch sound component read out from the musical sound PCM sound source 224 by the value (sound volume setting value) in accordance with the blowing pressure detected by the blowing pressure sensor 140, and thereby generates musical sound calculation waveform data (Step S314). Then, the sound generator LSI 170 ends the pitch sound source control processing, and returns to the main flow shown in FIG. 4.

As a result of the above-described configuration, when the amount (blowing pressure) of the instrument player's breath blown into the mouthpiece 10 is more than the predetermined threshold value (OFF threshold value) with the electronic wind instrument 100 performing musical sound emission, the processing for generating a musical sound in accordance with a sound pitch specified by a fingering operation and the processing for setting a sound volume in accordance with the amount (blowing pressure) of breath blown for the musical sound are continued. That is, a sound emission state of emitting a current musical sound is maintained. On the other hand, when the amount (blowing pressure) of breath blown into the mouthpiece 10 becomes less than the predetermined threshold value (OFF threshold value) with the electronic wind instrument 100 emitting a musical sound, the emission of the musical sound is stopped.

Next, in the main flow shown in FIG. 4, the sound generator LSI 170 combines the exhalation sound calculation waveform data generated by the noise sound source control processing (Step S110) with the musical sound calculation waveform data generated by the pitch sound source control processing (Step S112) and outputs them as a digital sound signal. Then, the CPU 110 converts the digital sound signal outputted from the sound generator LSI 170 into an analog signal via the DAC 185, and emits the corresponding sound from the sound emission section 180 (Step S114). As a result of this configuration, a musical instrument sound acquired by combining an exhalation sound having a noise sound component and a musical sound having a pitch sound component which are based on a sound pitch specified by a fingering operation is emitted from the speaker 5 at a controlled sound volume in accordance with the amount (blowing pressure) of breath blown into the mouthpiece 10.

Hereafter, the CPU 110 and the sound generator LSI 170 repeatedly perform the above-described Step S104 to Step S114 including the noise sound source control processing and the pitch sound source control processing, whereby musical instrument sounds are continuously emitted from the speaker 5 so as to play a musical piece. Note that, although omitted in the flowchart in FIG. 4, the CPU 110 terminates the above-described series of processing operations (Step S102 to Step S114) when a status change such as the interruption or completion of a musical performance is detected or when an anomaly occurs during the program execution.

Next, a musical instrument sound is described which is actualized by the control method (musical sound generation method) for the electronic wind instrument according to the present embodiment.

Figure 7:
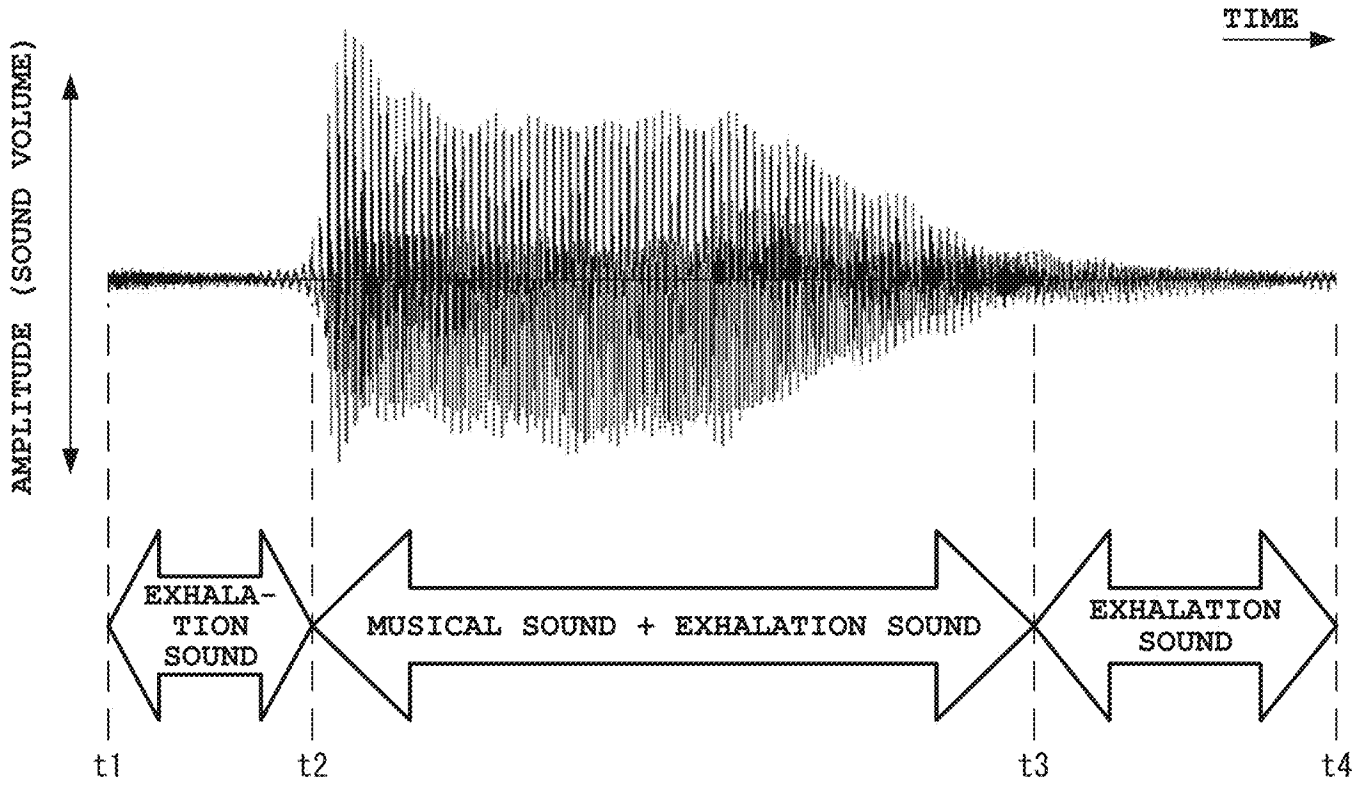
FIG. 7 is a waveform diagram showing an example of a musical instrument sound of an acoustic wind instrument.
Figure 8:
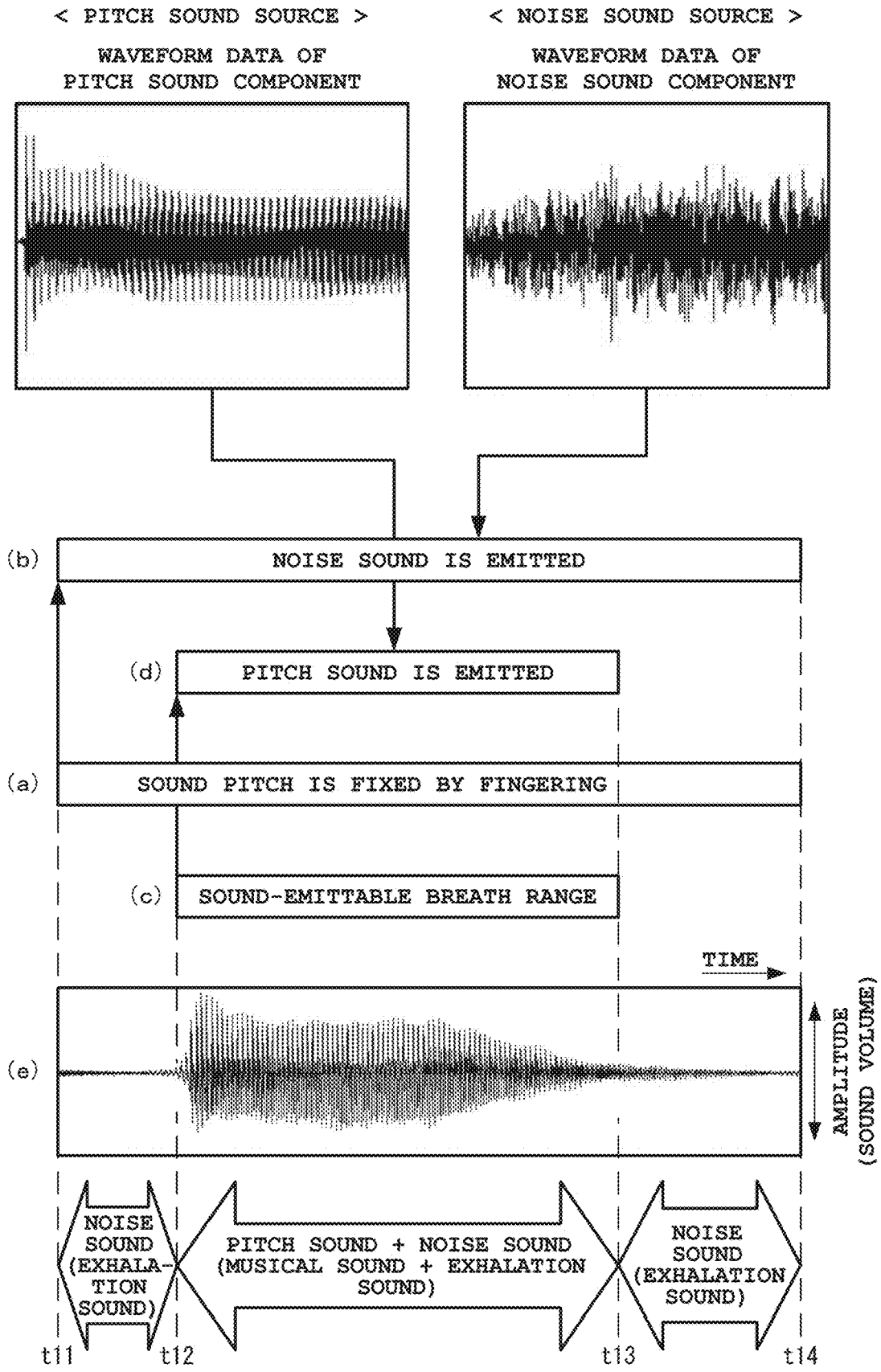
FIG. 8 is a waveform diagram showing an example of a musical instrument sound actualized by the control method for the electronic wind instrument according to the embodiment of the present invention.

FIG. 7 is a waveform diagram showing an example of a musical instrument sound of an acoustic wind instrument, and FIG. 8 is a waveform diagram showing an example of a musical instrument sound (a composite waveform of an exhalation sound and a musical sound) that is actualized by the control method (musical sound generation method) for the electronic wind instrument according to the present embodiment.

First, the musical instrument sound of the acoustic wind instrument is described. When a musical instrument player blows breath from the mouthpiece of the acoustic wind instrument so as to play the acoustic wind instrument, only an exhalation sound generated by the musical instrument player blowing the breath is emitted at first (from time t1) because the breath is weak at the beginning (that is, the amount of breath to be blown into the mouthpiece is small and therefore the blowing pressure is low). Subsequently, when the breath is forcefully blown thereinto (that is, the amount of breath to be blown into the mouthpiece is increased and therefore the blowing pressure is increased), the reed of the mouthpiece is vibrated, and a musical sound of a pitch specified by the instrument player using a finger hole switch is emitted (time t2 to time t3). Then, when the breath is gradually weakened (the amount of breath to be blown into the mouthpiece is decreased and therefore the blowing pressure is decreased), the musical sound stops and only the exhalation sound remains (from time t3). Eventually, the exhalation sound also stops, whereby the sound emission ends (time t4).

In the case of such an acoustic wind instrument, when breath is slowly blown into the mouthpiece, a musical sound is started to be emitted after an exhalation sound is emitted for a while. Conversely, when breath is forcefully blown into the mouthpiece, a musical sound is started to be emitted shortly after an exhalation sound is emitted. That is, a time lag (delay) inevitably occurs between when the instrument player blows breath into the mouthpiece and when a musical sound of a pitch specified by a finger hole switch is emitted. Accordingly, the instrument player is required to play such that, in order to emit each musical sound in time with a musical piece that is being played, a fingering operation for specifying a sound pitch and the blowing of breath into the mouthpiece are performed sufficiently earlier than timing at which the corresponding musical sound is emitted.

As such, in acoustic wind instruments, the sound emission timing of an exhalation sound and that of a musical sound differ in accordance with musical performance timing and status. Also, when breath is being blown into the mouthpiece of an acoustic wind instrument, an exhalation sound is constantly emitted. This means that musical sounds which people recognize aurally are mixed sounds of musical sounds and exhalation sounds related to sound pitches specified by finger hole switches.

For this reason, the present embodiment includes the sound sources (the pitch sound source and the noise sound source) in which, as sound source data, the waveform data of pitch sound components corresponding to musical sounds and the waveform data of noise sound components corresponding to exhalation sounds separated and extracted from, for example, the waveforms of sounds recorded in PCM in an actual musical performance using an acoustic wind instrument have been individually stored, as described above.

Also, when the above-described musical sound generation method of the present embodiment is performed, waveform data in accordance with a sound pitch is extracted from the noise sound source and a noise sound corresponding to an exhalation sound is generated in a time period (time t11 to time t14) in which the sound pitch is fixed by a fingering operation performed on the finger hole switch section 150 for a musical performance. This generated noise sound is set to have a sound volume in accordance with a blowing pressure detected by the blowing pressure sensor 140 and emitted from the sound emission section 180 (time t11 to time t12).

In a period (time t12 to time t13) corresponding to a sound-emittable breath range in which the blowing pressure detected by the blowing pressure sensor 140 is higher than the predetermined ON threshold value, waveform data in accordance with the sound pitch is extracted from the pitch sound source and a pitch sound corresponding to a musical sound is generated. Here, in the noise sound source, the noise sound corresponding to the exhalation sound is being continuously generated. These pitch and noise sounds are set to have sound volumes in accordance with the blowing pressure detected by the blowing pressure sensor 140, and then combined with each other, so that a musical instrument sound acquired by the pitch sound and the noise sounds being combined is emitted from the sound emission section 180 (time t12 to time t13).

Then, when the blowing pressure detected by the blowing pressure sensor 140 becomes lower than the predetermined OFF threshold value with the pitch sound corresponding to the musical sound being emitted, the generation of the pitch sound is stopped and only the noise sound is continuously generated. This noise sound is set to have a sound volume in accordance with the current blowing pressure detected by the blowing pressure sensor 140 and emitted from the sound emission section 180 (time t13 to time t14).

As a result of this method, a waveform model is replicated in which a noise sound corresponding to an exhalation sound is emitted at least before and after a time period in which a pitch sound corresponding to a musical sound is emitted, as with the instrument sound emitted from the acoustic wind instrument in FIG. 7.

Here, the noise sound corresponding to the exhalation sound is promptly started to be emitted at timing at which a sound pitch is determined by a fingering operation using the finger hole switch section 150, as shown in FIG. 8. Thus, the sound generator LSI 170 controls the noise sound generation processing in the noise sound source and the sound volume set processing in the multiplier 216 such that a noise sound in accordance with a specified sound pitch is emitted from the sound emission section 180 even when a blowing pressure detected by the blowing pressure sensor 140 is extremely low. In such a state where a blowing pressure is as extremely low as close to zero, generally, an analog noise component attributed to the detection performance of the blowing pressure sensor 140 is relatively large, and this component is included in a noise sound to be emitted from the sound emission section 180. Since one of the objects of the present invention is to emit a noise sound even when a blowing pressure is extremely low, such an analog noise component is also effectively attributed to the emission of a more effective noise sound.

As described above, in the present embodiment, a sound pitch is determined by a fingering operation performed on a finger hole switch for a musical performance by the electronic wind instrument, and a noise sound (exhalation sound) in accordance with the sound pitch is started to be emitted at timing at which the blowing of breath (the start of the blowing) is detected by the blowing pressure sensor. Here, when the blowing pressure detected by the blowing pressure sensor is lower than the ON threshold value set in advance, the sound volume of the noise sound is linearly controlled in accordance with the blowing pressure. Subsequently, when the blowing pressure becomes equal to or higher than the ON threshold value, a pitch sound (musical sound) in accordance with the sound pitch is started to be emitted in parallel with the sound emission of the noise sound (exhalation sound), and the sound volumes of the pitch sound and the noise sound are linearly controlled in accordance with the blowing pressure at that point. Then, when the blowing pressure becomes lower than the OFF threshold value, the sound emission of the pitch sound (musical sound) is stopped, and only the sound emission of the noise sound (exhalation sound) is continued.

As a result of this configuration, in the present embodiment, a more approximate sound emission characteristic and a more approximate musical performance effect can be replicated with respect to transition from when an exhalation sound is emitted in a musical performance using an acoustic wind instrument to when a musical sound is emitted and transition from when an instrument sound is being emitted to when the musical sound is stopped and only the exhalation sound is emitted, whereby an electric musical instrument can be actualized which provides a musical performance feeling close to that of an actual acoustic wind instrument.

In the above descriptions of the present embodiment, as a method for generating a noise sound in accordance with a sound pitch specified by a fingering operation performed on a finger hole switch (that is, an exhalation sound having a pitch sound component), the method has been described in which the waveform data of noise sound components for the respective sound pitches are stored in advance in the noise sound source, and waveform data in accordance with a specified sound pitch is extracted. However, the present invention is not limited thereto. For example, a method may be adopted in which waveform data that serves as a noise sound component base is stored in the noise sound source and, by the frequency band of the waveform data being restricted by a band pass filter having a frequency characteristic in accordance with a specified sound pitch, a noise sound in accordance with the sound pitch is generated. By this method as well, a noise sound (exhalation sound) in accordance with a specified sound pitch can be emitted, whereby an approximate sound emission characteristic and musical performance effect close to those of an actual acoustic wind instrument can be replicated.

(Modification Example)

Next, a modification example of the above-described embodiment is described.

Figure 9:
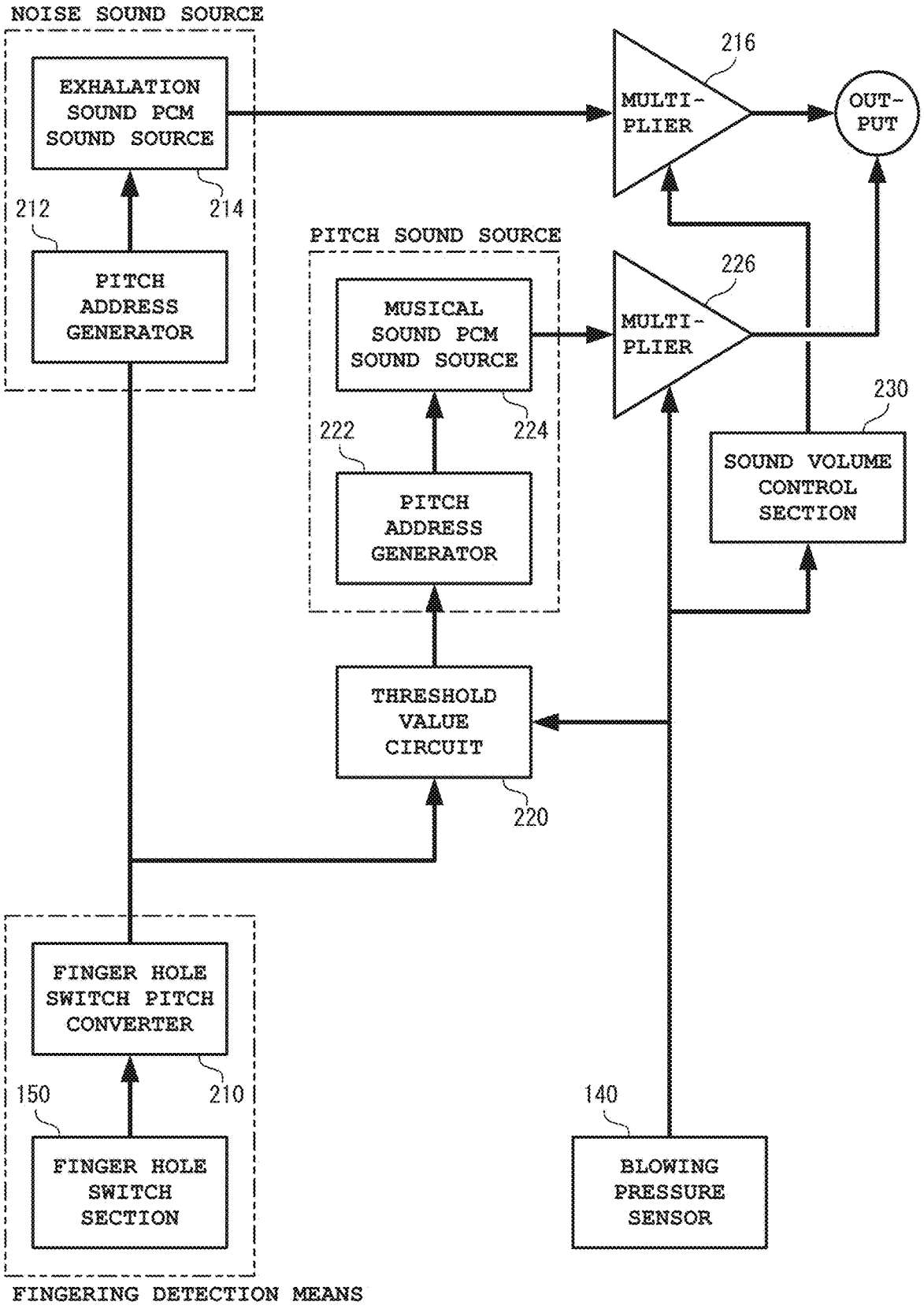
FIG. 9 is a functional block diagram for describing a modification example of the musical sound generation method for the electronic wind instrument according to the embodiment of the present invention.
Figure 10A:
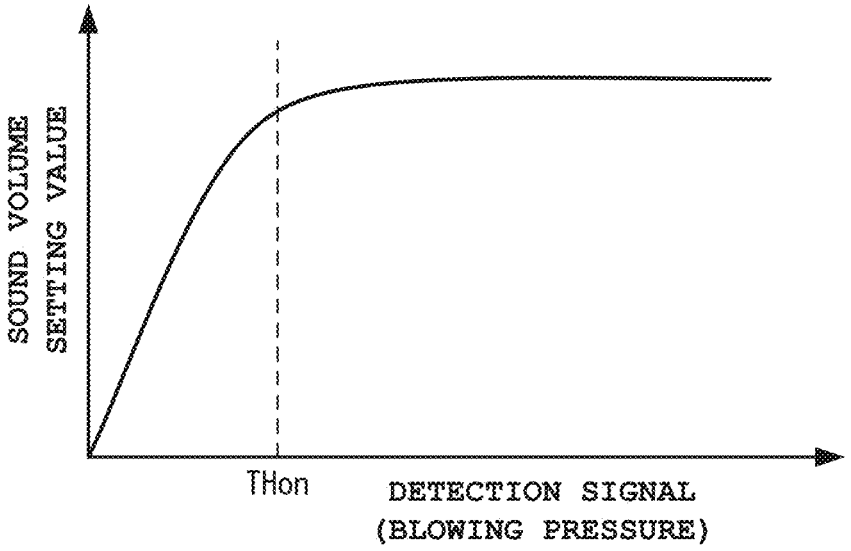
FIG. 10A is a conversion characteristic diagram showing an example of a sound volume setting conversion table applied in an electronic wind instrument control method according to the modification example of the embodiment of the present invention.
Figure 10B:
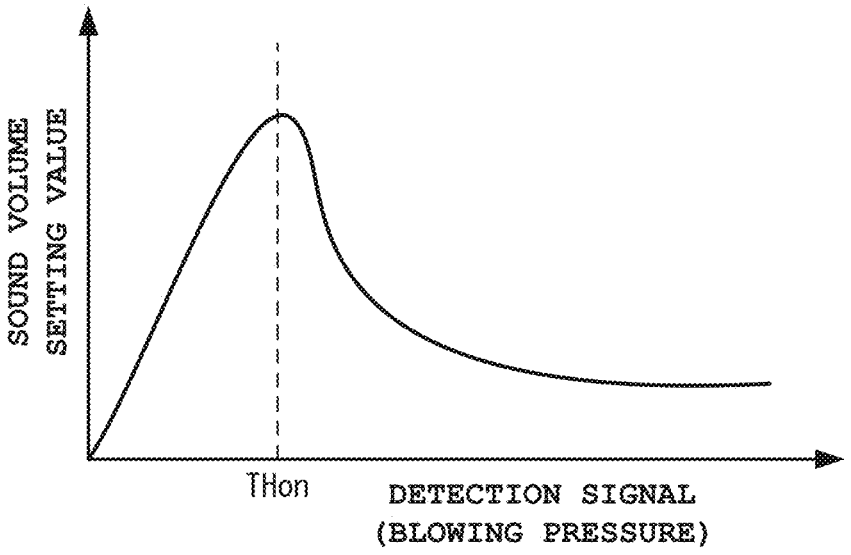
FIG. 10B is a conversion characteristic diagram showing another example of the sound volume setting conversion table applied in the electronic wind instrument control method according to the modification example of the embodiment of the present invention.

FIG. 9 is a functional block diagram for describing a modification example of the musical sound generation method for the electronic wind instrument according to the present embodiment, and FIG. 10A and FIG. 10B are conversion characteristic diagrams showing examples of a sound volume setting conversion table applied in an electronic wind instrument control method according to the modification example of the present embodiment.

In the above-described embodiment, in the multipliers 216 and 226 shown in FIG. 3, the sound volume of a noise sound corresponding to an exhalation sound and the sound volume of a pitch sound corresponding to a musical sound are controlled to be linearly increased as a blowing pressure detected by the blowing pressure sensor 140 becomes higher. In the modification example of the present embodiment, the setting of the sound volume of a noise sound based on a blowing pressure is controlled on the basis of a nonlinear conversion characteristic. That is, in the modification example, a conversion characteristic (nonlinear) with respect to a blowing pressure when the sound volume of an exhalation sound is set differs from a conversion characteristic (linear) when the sound volume of a musical sound is set.

In this modification example, a blowing pressure detected by the blowing pressure sensor 140 in the musical sound generation device of the above-described embodiment (functional block of FIG. 3) is inputted into the multiplier 216 on the noise sound source side via a sound volume control section 230, as shown in the example in FIG. 9. This sound volume control section 230 refers to a sound volume setting conversion table having a nonlinear conversion characteristic on the basis of the blowing pressure detected by the blowing pressure sensor 140, and thereby extracts and sets a sound volume setting value. The multiplier 216 multiplies a noise sound generated in the noise sound source by the sound volume setting value having nonlinearity, and thereby sets the sound volume of the noise sound. On the other hand, the multiplier 226 multiplies a pitch sound generated in the pitch sound source by a sound volume setting value having linearity with respect to the blowing pressure, and thereby sets the sound volume of the pitch sound, as with the above-described embodiment.

Here, the sound volume control section 230 has the sound volume setting conversion table having a curve characteristic such as that shown in FIG. 10A and FIG. 10B. In the sound volume setting conversion table shown in FIG. 10A, the conversion characteristic of its sound volume setting value with respect to blowing pressure has approximate linearity from the start of the blowing of breath into the mouthpiece 10 (from the "0" blowing pressure state) to a point close to an example ON threshold value THon set in the above-described threshold value circuit 220. On the other hand, a blowing pressure range equal to and higher than the ON threshold value THon in which a pitch sound corresponding to a musical sound is emitted has a conversion characteristic where convergence to a sound volume setting value (upper limit value) close to the ON threshold value THon is performed. As a result of this configuration, until a pitch sound corresponding to a musical sound is emitted, the sound volume of a noise sound is linearly changed in accordance with a blowing pressure, and then stabilized after the pitch sound is emitted. Consequently, the pitch sound (musical sound) is relatively highlighted, whereby a sound emission characteristic and a musical performance effect close to those of acoustic wind instruments are replicated.

Also, the sound volume setting conversion table shown in FIG. 10B has a conversion characteristic having approximate linearity from the start of the blowing of breath to a point close to the ON threshold value THon as in the case of FIG. 10A, and a conversion characteristic by which, in a blowing pressure range equal to or higher than the ON threshold value THon, the sound volume setting value is decreased or converges to a sound volume setting value (lower limit value) lower than a point close to the ON threshold value THon. As a result of this configuration, the sound volume of a noise sound is kept low after a pitch sound is emitted, so that the pitch sound (musical sound) is relatively more highlighted. Generally, musical instrument sounds from an acoustic wind instrument are recognized by the human auditory sense such that noise sounds become relatively smaller as pitch sounds become bigger. Therefore, by the sound volume setting conversion table shown in FIG. 10B being adopted, a sound emission characteristic and a musical performance effect close to those of acoustic wind instruments can be replicated.

The sound volume setting conversion tables shown in FIG. 10A and FIG. 10B are created on the basis of a curve characteristic approximate to the tendency of the relative sound volume change of a noise sound component when, for example, an acoustic wind instrument is actually played. Note that the sound volume control section 230 of the modification example may include, for example, a plurality of sound volume setting conversion tables whose conversion characteristics differ from each other. In that case, by the operation switch section 160 or the like being operated, the sound volume setting conversion tables are arbitrarily switched and the conversion characteristic is adjusted.

In the above-described embodiment, a noise sound (exhalation sound) in accordance with a sound pitch specified by a fingering operation performed on the finger hole switch section 150 is emitted between the start of the blowing of breath and the sound emission of a musical sound during a musical performance using the electronic wind instrument 100. However, in another modification example of the present embodiment, control is performed by which the sound of operating the finger hole switch section 150 is emitted in addition to a noise sound. Generally, when a sound pitch is to be specified by a fingering operation on an acoustic wind instrument, the sound (machine sound such as "clackety-clack" or "tick-tack") of operating a finger hole switch occurs. In light of this fact, in this modification example, the sound of operating a finger hole switch recorded or generated in advance is stored, and emitted in synchronization with the timing of an operation on the finger hole switch section 150, and then a noise sound and a pitch sound are emitted by the above-described musical sound generation method. As a result of this configuration, an electric musical instrument is actualized which gives a musical performance feeling close to that of an actual acoustic wind instrument.

Also, in the above-described embodiment, the series of musical sound generation processing operations is performed by the sound generator LSI 170. However, the present invention is not limited thereto, and a configuration may be adopted in which the musical sound generation processing is performed by the CPU 110 having a function equivalent to that of the sound generator LSI 170.

In the above-described embodiment and the modification examples, as a change characteristic when a noise sound generated by the noise sound source is set to have a sound volume in accordance with a blowing pressure by the multiplier 216, the sound volume setting value has linearity or non-linearity (curve characteristic) with respect to change in a blowing pressure, and changes continuously. However, the present invention is not limited thereto. For example, a change characteristic may be adopted by which the sound volume setting value changes in stages with respect to a blowing pressure. In that case, for example, when the blowing pressure is less than the ON threshold value, a relatively low fixed sound volume allowing a noise sound to be emitted is set. When the blowing pressure is equal to or higher than the ON threshold value, a relatively large sound volume in accordance with the blowing pressure is set.

Also, in the above-described embodiment, the electronic wind instrument 100 has been shown which has a saxophone-like external shape. However, the present invention is not limited thereto, and may be applied in any electronic musical instrument modeled after another acoustic wind instrument such as a clarinet or a trumpet as long as it has a configuration where a blowing pressure by exhalation in a musical performance is detected and the sound volume of a musical sound to be emitted is controlled.

While the present invention has been described with reference to the preferred embodiments, it is intended that the invention be not limited by any of the details of the description therein but includes all the embodiments which fall within the scope of the appended claims.

Therefore, the detailed structure and detailed operation of each component of the electronic wind instrument 100 in the above-described embodiment can be appropriately changed within the scope of the present invention.

What is claimed is:

1. A musical sound generation device comprising:

a blowing pressure sensor which detects a blowing pressure;

a key switch which specifies a sound pitch of a musical sound;

a first sound source which outputs a first signal corresponding to an exhalation sound;

a second sound source which outputs a second signal corresponding to the musical sound having the sound pitch specified by the key switch; and a processor, wherein the processor (i) starts output of the first signal by the first sound source on basis of an operation performed on the key switch, (ii) starts output of the second signal by the second sound source on basis of the blowing pressure detected by the blowing pressure sensor, and (iii) controls a sound volume when the exhalation sound resulting from the first signal is emitted and a sound volume when the musical sound resulting from the second signal is emitted, on basis of the blowing pressure.

2. The musical sound generation device according to claim 1, wherein the processor controls the first sound source to output the first signal which has a noise sound component in accordance with the sound pitch specified by the key switch.

3. The musical sound generation device according to claim 1, wherein the processor controls the first sound source to start the output of the first signal at timing at which the sound pitch of the musical sound is determined by the key switch.

4. The musical sound generation device according to claim 1, further comprising:

a first sound volume setter which inputs the first signal outputted by the first sound source, adjusts the first signal such that the exhalation sound is emitted at a specified sound volume, and outputs the first signal; and a second sound volume setter which inputs the second signal outputted by the second sound source, adjusts the second signal such that the musical sound is emitted at a specified sound volume, and outputs the second signal, wherein the processor controls the sound volume to be specified for the first sound volume setter and the sound volume to be specified for the second sound volume setter on different conditions based on the blowing pressure.

5. The musical sound generation device according to claim 4, wherein the processor controls such that a change characteristic of the sound volume of the exhalation sound which is set by the first sound volume setter and a change characteristic of the sound volume of the musical sound which is set by the second sound volume setter are different from each other, in accordance with the blowing pressure detected by the blowing pressure sensor.

6. The musical sound generation device according to claim 4, wherein the processor controls to output only the exhalation sound resulting from the first signal without outputting the musical sound resulting from the second signal, when the blowing pressure detected by the blowing pressure sensor is less than a threshold value set in advance, and wherein the processor controls to output the exhalation sound resulting from the first signal and the musical sound resulting from the second signal and to set the sound volume of the musical sound by the second sound volume setter on basis of the blowing pressure, when the blowing pressure is equal to or more than the threshold value.

7. The musical sound generation device according to claim 6, wherein the processor controls the first sound volume setter such that a sound volume is set which enables the exhalation sound resulting from the first signal to be emitted, even when the blowing pressure detected by the blowing pressure sensor is less than the threshold value.

8. The musical sound generation device according to claim 6, wherein the processor controls the second sound volume setter to stop emission of the musical sound resulting from the second signal, and controls the first sound volume setter to continue emission of the exhalation sound resulting from the first signal, when the blowing pressure detected by the blowing pressure sensor becomes less than the threshold value after becoming equal to or more than the threshold value.

9. An electronic wind instrument comprising:

the musical sound generation device according to claim 1;

a mouthpiece into which breath for a musical performance is blown; and a sound emitter which emits the exhalation sound for which the sound volume has been set or a musical instrument sound acquired by combining the exhalation sound for which the sound volume has been set and the musical sound, on basis of the blowing pressure in accordance with an amount of breath blown into the mouthpiece.

10. A musical sound generation method for a musical sound generation device including a blowing pressure sensor which detects a blowing pressure, a key switch which specifies a sound pitch of a musical sound, a first sound source which outputs a first signal corresponding to an exhalation sound, and a second sound source which outputs a second signal corresponding to the musical sound having the sound pitch specified by the key switch, comprising:

starting output of the first signal by the first sound source on basis of an operation performed on the key switch;

starting output of the second signal by the second sound source on basis of the blowing pressure detected by the blowing pressure sensor; and controlling a sound volume when the exhalation sound resulting from the first signal is emitted and a sound volume when the musical sound resulting from the second signal is emitted, on basis of the blowing pressure.

11. A non-transitory computer-readable storage medium having stored thereon a program that is executable by a computer in a musical sound generation device including a blowing pressure sensor which detects a blowing pressure, a key switch which specifies a sound pitch of a musical sound, a first sound source which outputs a first signal corresponding to an exhalation sound, and a second sound source which outputs a second signal corresponding to the musical sound having the sound pitch specified by the key switch, the program being executable by the computer to actualize functions comprising:

starting output of the first signal by the first sound source on basis of an operation performed on the key switch;

starting output of the second signal by the second sound source on basis of the blowing pressure detected by the blowing pressure sensor; and controlling a sound volume when the exhalation sound resulting from the first signal is emitted and a sound volume when the musical sound resulting from the second signal is emitted, on basis of the blowing pressure.

* * * * *